US007150645B2

(12) United States Patent
Huang

(10) Patent No.: US 7,150,645 B2
(45) Date of Patent: Dec. 19, 2006

(54) ELECTRICAL CONNECTOR WITH GUIDING DEVICE

(75) Inventor: Chien Hsun Huang, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/104,208

(22) Filed: Apr. 11, 2005

(65) Prior Publication Data

US 2006/0003615 A1 Jan. 5, 2006

(30) Foreign Application Priority Data

Jun. 30, 2004 (TW) ..... 93119332 A

(51) Int. Cl.
*H01R 13/64* (2006.01)
*H01R 13/44* (2006.01)

(52) U.S. Cl. ..... 439/378; 439/137

(58) Field of Classification Search ..... 439/138, 439/137, 135, 953, 378, 374, 136, 108, 101, 439/139–140

See application file for complete search history.

(56) References Cited

U.S. PATENT DOCUMENTS 6,142,814 A * 11/2000 Wu et al. ..... 439/378
6,877,999 B1 * 4/2005 Hashimoto ..... 439/138
2001/0031570 A1 * 10/2001 Horikoshi et al. ..... 439/137
2002/0177336 A1 11/2002 Sasame et al.
2003/0077929 A1 4/2003 Funatsu

FOREIGN PATENT DOCUMENTS

CN 1291808 A 4/2001

* cited by examiner

*Primary Examiner*—Felix O. Figueroa
(74) *Attorney, Agent, or Firm*—Wei Te Chung

(57) ABSTRACT

An electrical connector (500) for mating with a mating electrical connector (500) includes an insulative housing (6), a number of terminals received in the insulative housing and a guiding device (7). The insulative housing has a concave chamber for receiving the guiding device, a guiding device movably assembled to the insulative housing comprises guiding members (71) and spring members (72). The spring members arranged in the concave chamber and below the guiding members, the guiding members can move along the concave chamber due to the elasticity of the spring members.

12 Claims, 7 Drawing Sheets

ELECTRICAL CONNECTOR WITH GUIDING DEVICE

BACKGROUND OF THE INVENTION

1. Field of the Invention

The present invention generally relates to an electrical connector, and more particularly to an electrical connector with guiding device.

2. Description of Related Art

Electrical connectors are commonly used in devices, such as personal computers, for electrically connecting electronic parts mounted on circuit boards to each other. If the electrical connectors mismate with mating electrical connectors, contacts occur impact so as to damnify the contacts and affect electrical connecting of the electrical connectors. Accordingly, the electrical connectors always need guiding devices for prevent the electrical connectors from mismating with each other. But, the conventional guiding devices are over mating portions of the electrical connectors, so that assembled electrical connectors have higher profile and cann't meet the request for miniaturization.

China patent application Pub. No. CN1291808A discloses an electrical connector with guiding device. The electrical connector includes a guiding device, the guiding device comprises guiding portions and guiding posts with springs. The guiding portions have hollow passageways in the center thereof, the guiding posts have larger head portions and post bodies with coil springs. The coil springs are arranged between the head portions and the flanges of the guiding portions around the post bodies, and shorten or lengthen due to outer force to be loaded or not, so the guiding posts can move along the passageways of the guiding portions. When a mating electrical connector mates with the electrical connector, length of the coil springs can shorten because of the outer force, however the guiding post maintain original shape just moving a certain distance along the passageways, as a result, high of electrical connector assembly in whole will not change.

Another embodiment disclosed in aforementioned document provides guiding devices with changed structure, according to figures of the document, as the lower portion of the larger head portion should be received in the hollow passageways so that the whole guiding post can be guided into the passageways smoothly, the height of electrical connector must be bigger than the length of the non-compressed coil spring. On the other hand, the meeting of the fatter posts after the upper fatter post moving a certain distance confines the coil springs to be compressed further. Anyhow, the electrical connector assembly lust can be little shortened basing on the complex configuration thereof shown in figures.

Hence, it is desired to provide an improved electrical connector with guiding device to overcome the aforementioned disadvantages of the prior art.

SUMMARY OF THE INVENTION

A main object of the present invention is to provide an electrical connector with a guiding device to shorten profile of electrical connector assembly.

Anther object of the present invention is to provide an electrical connector with a guiding device having simple structure.

In order to achieve the object set forth, an electrical connector in accordance with the present invention includes an insulative housing, a plurality of terminals received in the insulative housing and a guiding device. The insulative housing has a concave chamber for receiving the guiding device, a guiding device movably assembled to the insulative housing comprises guiding members and spring members. The spring members arranged in the concave chamber and below the guiding members, the guiding members can move along the concave chamber due to the elasticity of the spring members.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
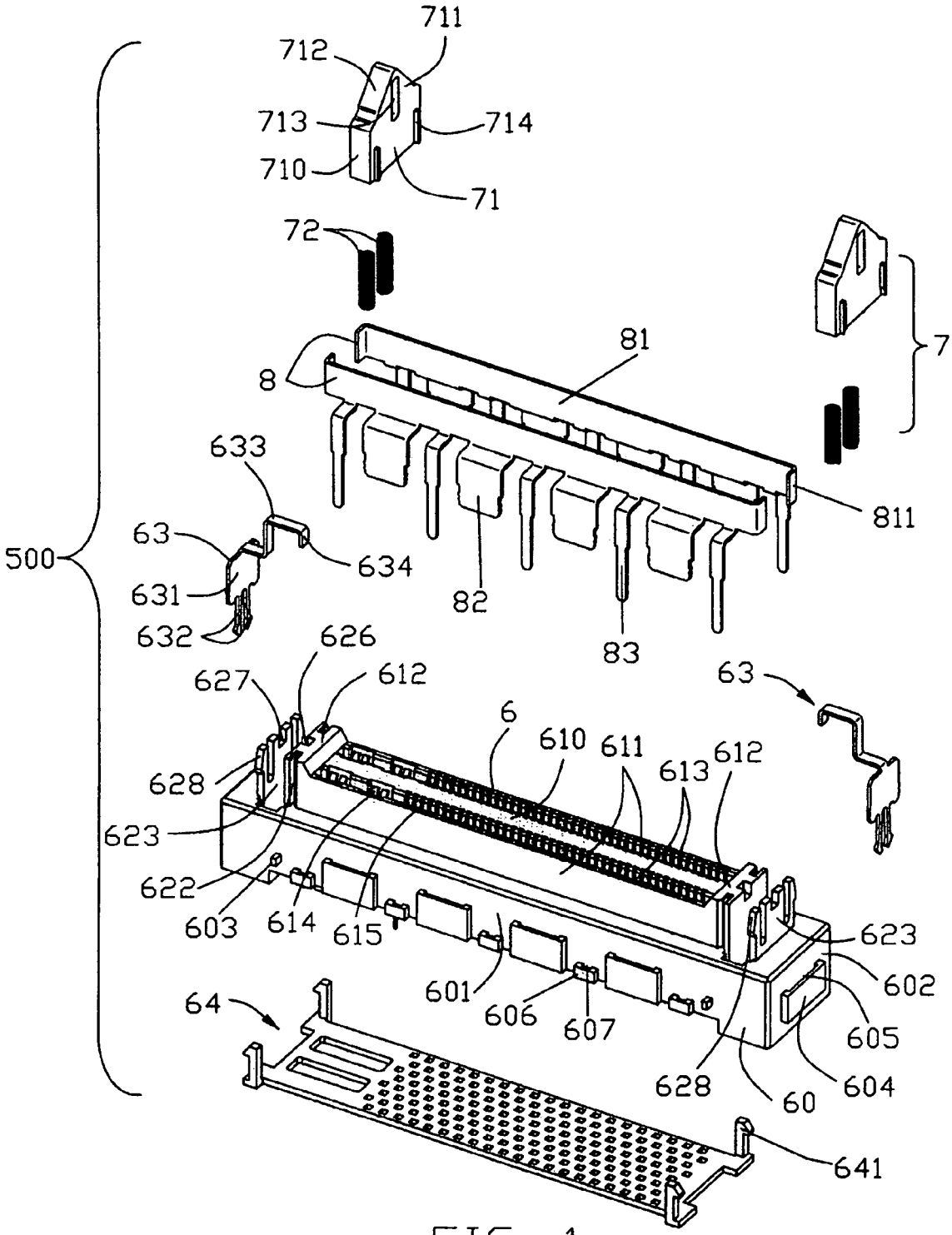
FIG. 1 is an exploded, perspective view of an electrical connector in accordance with the present invention.
Figure 2:
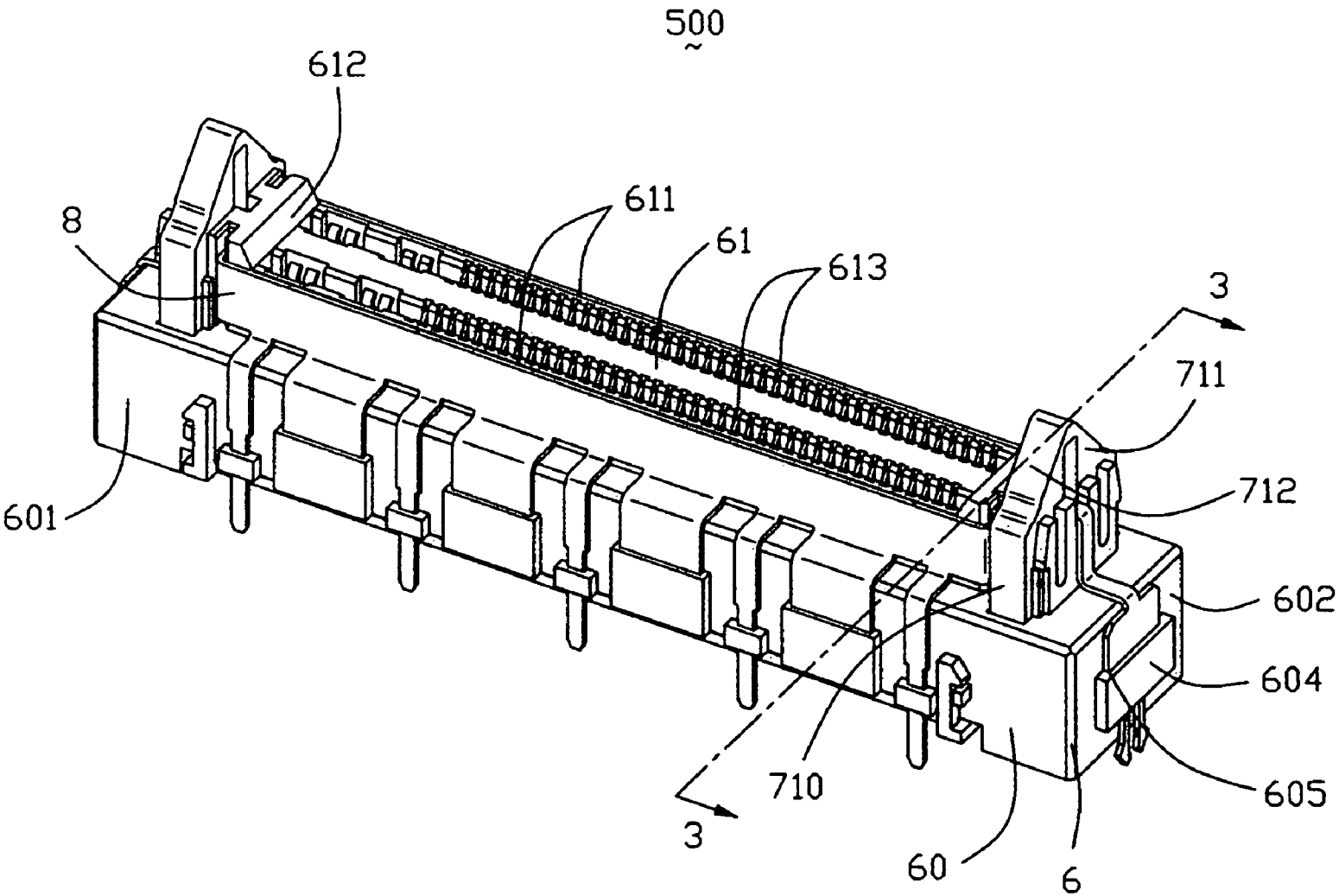
FIG. 2 is an assembled perspective view of the electrical connector of FIG. 1.

Referring to FIG. 1 in conjunction with FIG. 2, an electrical connector 500 in accordance with the present invention comprises an insulative housing 6, a guiding device 7, a pair of shield plates 8, a positioning plate 64 and a plurality of terminals.

The insulative housing 6 comprises a base 60, a mating portion (not labeled) above the base 60 for mating with a mating electrical connector 300 (shown in FIG. 4) and the guiding device 7.

The base 60 has a general shape of an elongate club, comprises a pair of side faces 601 along lengthwise direction and a pair of end faces 602. Each side face 601 has a pair of tabs 603 for fixing the positioning plate 64, a plurality of positioning members 606 with a through hole 607 thereof. Each end face 602 has a positioning member 604 with a through hole 605 for positioning a grounding terminal. The base 60 further defines a space (not labeled) in bottom portion for receiving and locating the positioning plate 64.

Figure 3:
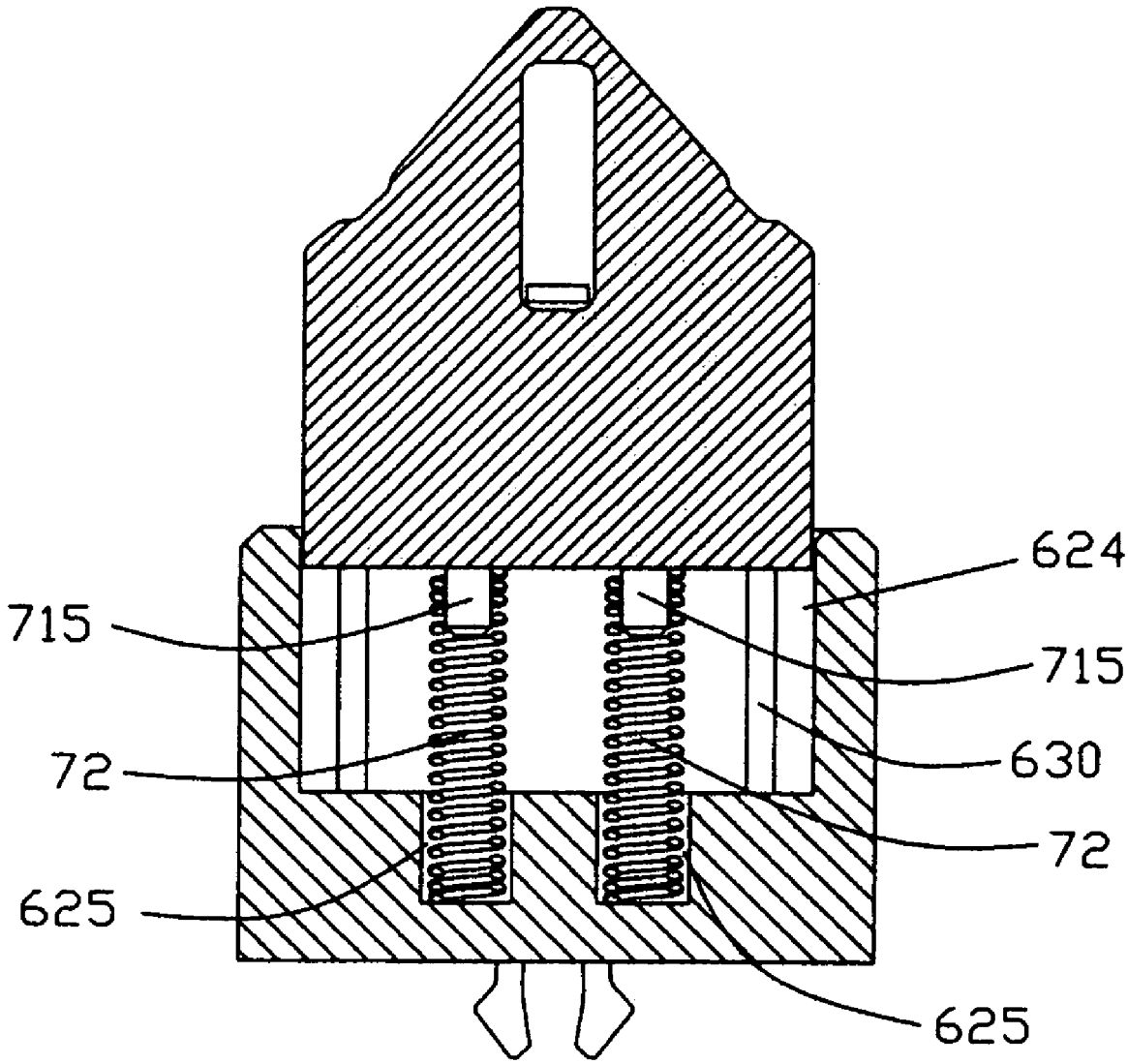
FIG. 3 is a cross-section view taken along line 3—3 of FIG. 1.

The mating portion has a middle portion (not labeled), a pair of upright walls 623 and two concave chambers (not labeled) each defined between the middle portion and each upright wall 623. The middle portion protrudes upwards from a center portion of the base 60, extends along the lengthwise direction of the base 60. The middle portion comprises a pair of lengthwise sidewalls 611, a pair of thick end walls 612 and a middle wall 610. The middle wall 610 parallels to two sidewalls 611 and connects to the end walls 612, two lengthwise receiving spaces (not labeled) for receiving the elongate tongues 14 of the mating electrical connector 300 are defined between the sidewalls 611 and the middle wall 610. A plurality of passageways 614, 615 are defined on inside surfaces of the sidewalls 611 and two opposite side surfaces of the middle wall 610. The passageways 614, 615 are throughout the base 60. Each end wall 612 comprises a cutout 626 at an up edge thereof and a pair of upright slots 622 opened on two laterals respectively in end wall 612. As shown in FIG. 3, the concave chambers are defined between the middle portion and the upright walls 623 in the base 60, the concave chamber comprises a cavity 624 with four grooves 630 and two circular holes 625 extending downwardly from the cavity 624. Each upright wall 623 is substantial E-shaped opened upwards, and is parallel to each end wall 612. Each upright wall 623 has two lateral sections (not labeled) and a middle section (not labeled) therebetween. The middle section defines a cutout 626 corresponding to the cutout 627, and the lateral section comprises a latching tab 628 acting as a limitation member for limiting the guiding device 7 to get out of the concave chamber. Two intervals (not labeled) are defined between the middle section and each lateral section.

The guiding device 7 assembled with the insulative housing 6 comprise a pair of guiding members 71 and two pairs of coil springs 72. The guiding members 71 are plates with substantial hill-shaped, each guiding member 71 comprises a body potion 710 and a top portion 711, the body potion 710 comprises two pairs of latching protrusions 714 on two side faces and two posts 715 extending downwards from bottom face thereof. The top portion 711 comprises a pair of guiding faces 712 and a through hole 713 through two side surfaces thereof.

To assembly the guiding devices 7 with the insulative housing 6, following such steps: firstly, placing the coil springs 72 in the concave chamber with one end of each coil spring 72 in one circular hole 625; secondly, providing the guiding members 71 with the post aiming at the other ends of the coil springs 72; thirdly, pressing the lateral sections of the upright wall 623 to the middle section, and pushing the guiding members 71 to slide downwards with the latching protrusions 714 of one side of the guiding members 71 clipping outer edges of the end walls 612 between each upright wall and the middle portion until the latching tab 628 beyond the latching protrusions 714 of the other side of the guiding members 71; finally, undoing the pressing on the lateral sections, accordingly, the lateral sections comeback original station and the latching tabs 628 press the latching protrusions 714 to prevent the guiding members 71 from getting out of the concave chambers.

In assembly, one guiding member 71 and a pair of coil springs 72 are located in one concave chamber, lower section of the body portion 710 are received in upper space of the concave chamber, one end of each coil spring 72 locates in each circular hole 625, and the other end of each coil spring 72 encircles around the post 715. The guiding members 71 can move down and up by means of the latching protrusions 714 sliding along the grooves 630, but the guiding members 71 can not get upwards out of the concave chambers because of the lathing tab 628.

The shield plates 8 cover the insulative housing 6, each shield plate 8 includes a main portion 81 for covering the sidewall 611 of the middle portion and a plurality of latching pieces 82 and pins 83. The main portions 81 have curving sections 811 at two ends thereof for attaching to the upright slots 622, and the latching pieces 82 and the pins 83 pass through the through holes 605 of the positioning members 604 respectively to fix the shield plates 8 on the insulative housing 6, as shown in FIG. 2.

Referring to FIGS. 1–2, the positioning plate 64 assembled to the bottom face of the insulative housing 6 comprises four locking members 641 for engaging with the tabs 603 and a plurality of apertures (not labeled) corresponding to the passageways 614, 615.

Terminals received in the electrical connector 500 are divided into tree types: signal terminals, power terminals and grounding terminals 63. The signal terminals and the power terminals are retained in the corresponding passageways 614, 615 with lower ends passing trough the apertures of the positioning plate 64. There are two grounding terminals 63 in the electrical connector 500, each grounding terminal 63 (as shown in FIG. 1) comprises a fixing end 633, a middle portion 631 and a grounding end 632. The fixing ends 633 have a distal end 634 corresponding to mating face of to upright walls 623 and the base 60 to pass through the through holes 713 of the guiding devices 7 and assemble with the cutouts 626, 627 of the mating portions. The middle portions 631 are located in the insulative housing 6 by means of passing through the through holes 605 of the positioning members 604. The grounding ends 632 extend downwards from the middle portion 631, and each grounding end 632 has two grounding pins to electrically connect with a printed circuit board (not shown).

Figure 4:
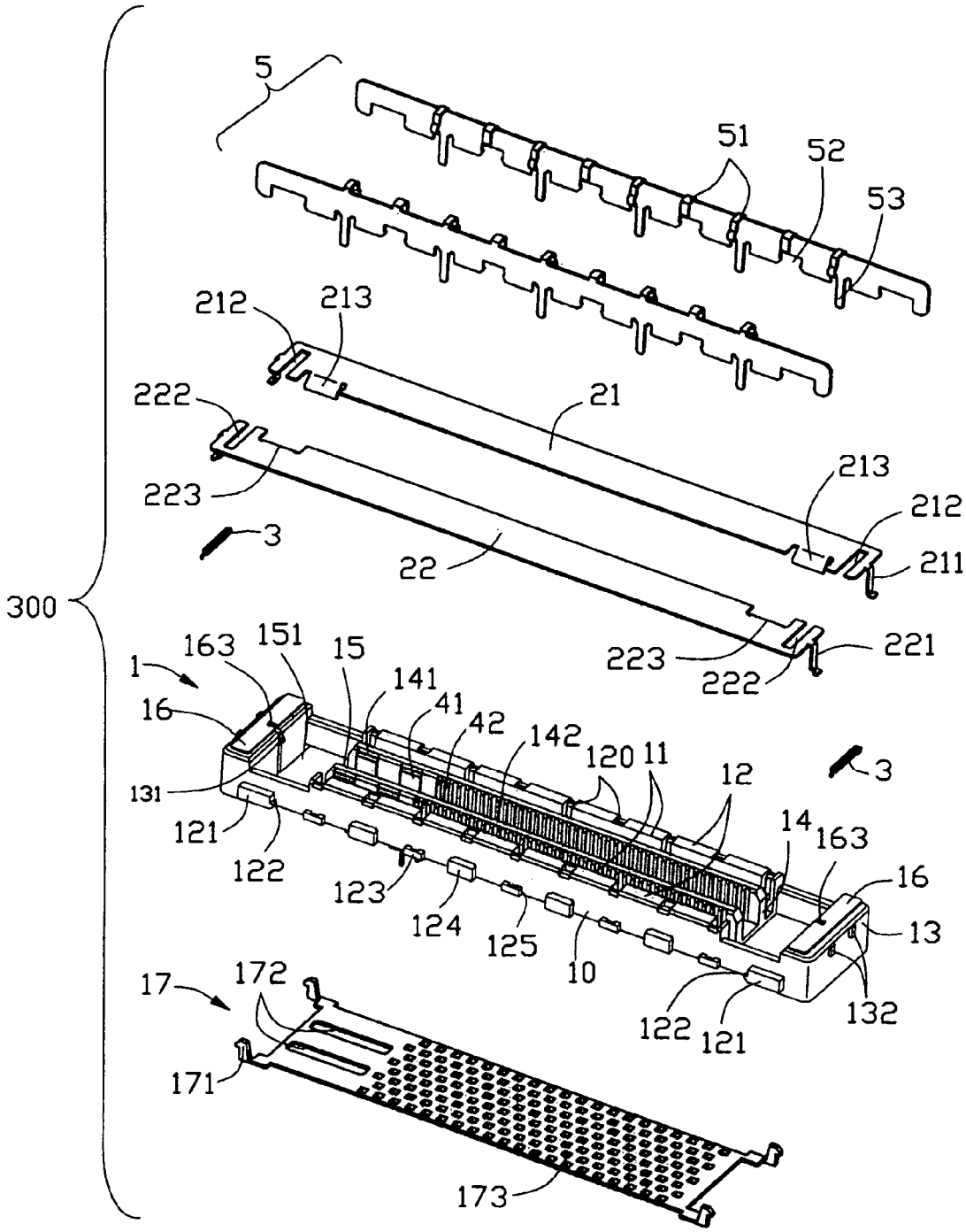
FIG. 4 is an exploded, perspective view of a mating electrical connector for engaging with the electrical connector shown in FIG. 1.
Figure 5:
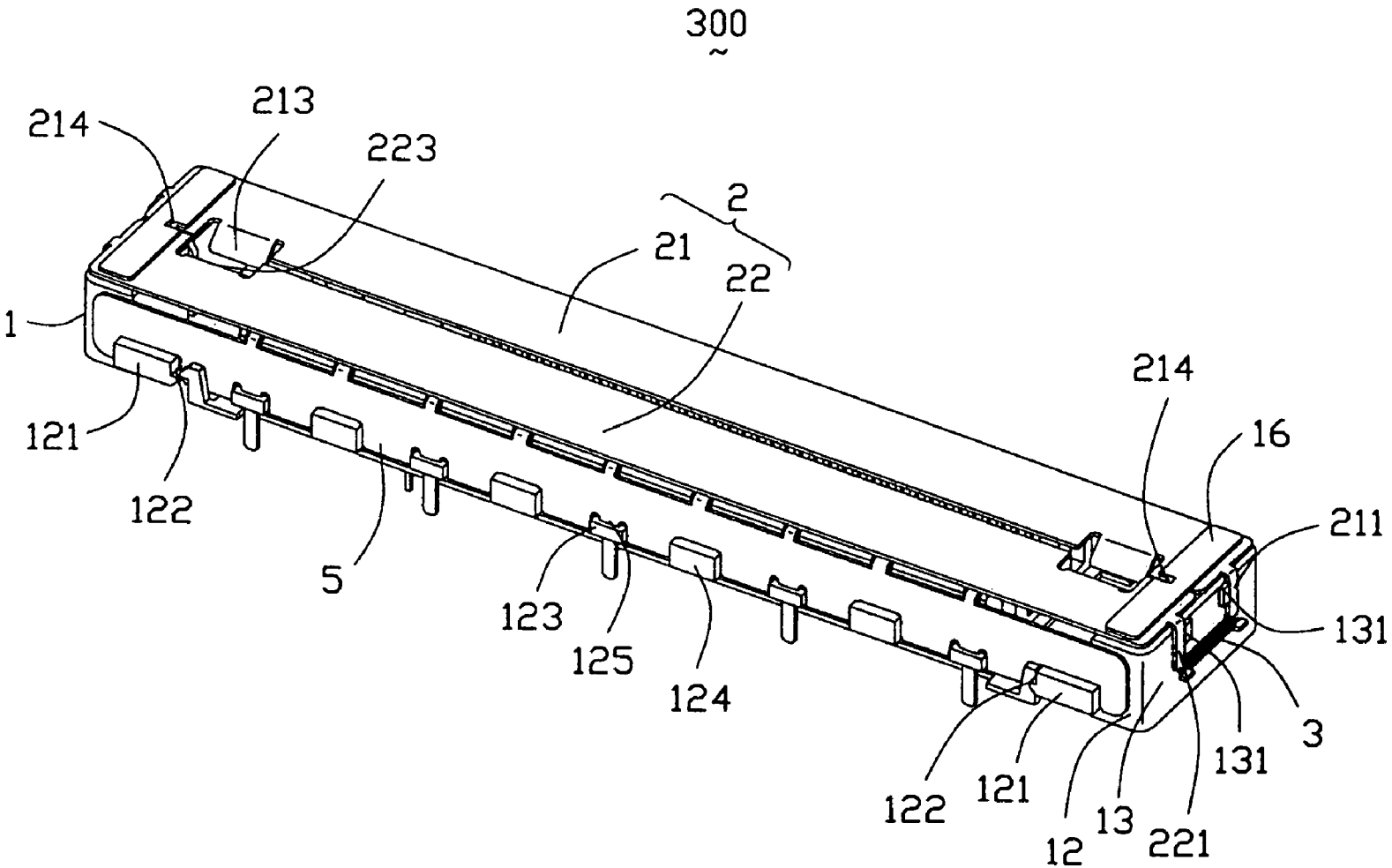
FIG. 5 is an assembled perspective view of the mating electrical connector of FIG. 4.

Referring to FIGS. 4–5, the mating electrical connector 300 for mating with the electrical connector 500 comprises an insulative housing 1, a plurality of terminals (not labeled) retained in the insulative housing 1, a shielding device 5, a positioning plate 17 and a shutter 2.

Referring to FIG. 4 in conjunction with FIG. 5, the insulative housing 1 is substantially rectangular in shape and made out of a material such as a synthetic resin. The insulative housing 1 has a base 10, a pair of sidewalls 12, a pair of end walls 13 and a pair of elongate tongues 14 extending in the lengthwise direction of the insulative housing 1. A mating portion 11 for mating with the electrical connector 500 is provided at an upper surface of the insulative housing 1, and a mating space 15 is defined between the base 10, the sidewalls 12 and the end walls 13, and comprises a pair of guiding chambers 151 in the vicinity of the end walls 13 respectively. Terminals retained in the insulative housing 1 are divided into three types: signal terminals 42, power terminals 41 and grounding terminals (not labeled).

The sidewalls 12 of the insulative housing 1 are opposite to each other, each sidewall 12 comprises a pair of latching member 121 with a bulge 122 protruding outwardly from the sidewalls 12 near the end walls 13 respectively. A plurality of locating members 123 with a through hole 125 and a plurality of protrusions 124 are formed in turn on the outside surface of each side wall 12 between two latching members 121 in turn. All of the locating members 121, the locating members 123 and the protrusions 124 are formed on lower portion of each sidewall 12. Each sidewall 12 further defines a plurality of cutouts 120 at up edge thereof.

The pair of end walls 13 opposite to each other, and each end wall 13 comprises an first engaging portion 16 on an up surface thereof, two stopper member 132 on an outside surface thereof, and a groove 131 on an inside surface thereof throughout the base 10. Each first engaging portion 16 comprises a limitation section (not labeled) and a first guiding section (not shown) along which the shutter 2 moves between a closed position and an open position. Referring to FIG. 4, the first engaging portion 16 has a T-shaped cross-section, the limitation section is a flat member parallel to the up surface of the end walls 13, the first guiding member is an elongate upright member. Height of the first guiding member equals to thickness of the shutter 2. The limitation sections and the first guiding sections extend along the end walls 12, and each limitation section further defines a gap 163 corresponding to the groove 131 to secure a grounding terminal 23 at an inside edge thereof.

The elongate tongues 14 are formed within the mating space 15 and spaced apart from each other, and each elongate tongue 14 defines a plurality of direct smaller terminal passageways 142 for receiving signal terminals 42 and larger terminal passageways 142 for recovering power terminals 41 on both sides thereof, the larger terminal passageways 141 are defined at two side surfaces of one end of each elongate tongue 14, all of the passageways 141, 142 are throughout of the base 10.

The shutter 2 movably assembles with the insulative housing 1 to cover the mating portion 11 of the insulative housing 1, comprises a pair of shutter members 21, 22 and a pair of coil springs 3. The shutter members 21, 22 have symmetrical structures, and are arranged side by side in a plane. Take the shutter member 21 example for illustrating the structure of the shutter members 21, 22 in detail as below. The shutter member 21 is a substantially rectangle shaped plate, comprises a pair of arms 211 extending downwards from opposite ends in the lengthwise direction thereof, a pair of second engaging portion 212 adjacent to the ends, and a pair of oblique planes 213 inclining downwards from a main plate thereof. The second engaging portion 212 is an elongate slot opened on an inside edge near to the shutter member 22, and corresponds in dimension to the first guiding section. Width of the second engaging portions 212 is larger than that of the first guiding sections. The shutter member 22 comprises a pair of arms 221, a pair of second engaging portion 222 and a pair of oblique planes 223 as the shutter member 21. In assembly, the second engaging portions 212, 222 of two shutter members 21, 22 movably engage with two ends of one first guiding section respectively below the limitation section. Each oblique plane 213 of one shutter member 21 opposite to each oblique plane 223 of another shutter member 22 respectively, and oblique planes 213, 223 are corresponding to locations of the guiding chamber 151. Each coil spring 3 connects two shutter members 21, 22 with two ends fixed to two arms 211, 221 of two shutter members 21, 22 in same ends respectively, and the stopper members 132 resist the arms 211, 221 to prevent the shutter members 21, 22 from overlapping.

The shielding device 5 for diverting the electrostatic discharge comprises a pair of shield members (not labeled), each shield member is made of metal and comprises a plurality of hooks 51 extending laterally and downwards from an up edge thereof, a plurality of cutouts 52 on an down edge thereof and a plurality of pins 53 extending downwards from the down edge thereof. Two shield members are assembled with the insulative housing 1, and the hooks 51 engage with the cutouts 120 respectively, the cutouts 52 fasten on the latching members 121 and the protrusions 124, and the pins 53 pass through the through holes 125 of the locating members 123.

The positioning plate 17 is a plate-shaped, defines a plurality of small holes 173 and two elongate holes 172 through the plate body, and the small holes 173 and elongate holes 172 are corresponding to the small terminal passageways 142 and the lager terminal passageways 141. Four latching members 171 extend upwards from four corners of the plate body for engaging with the bulges 122 of the latching members 121 of the insulative housing 1.

Figure 6:
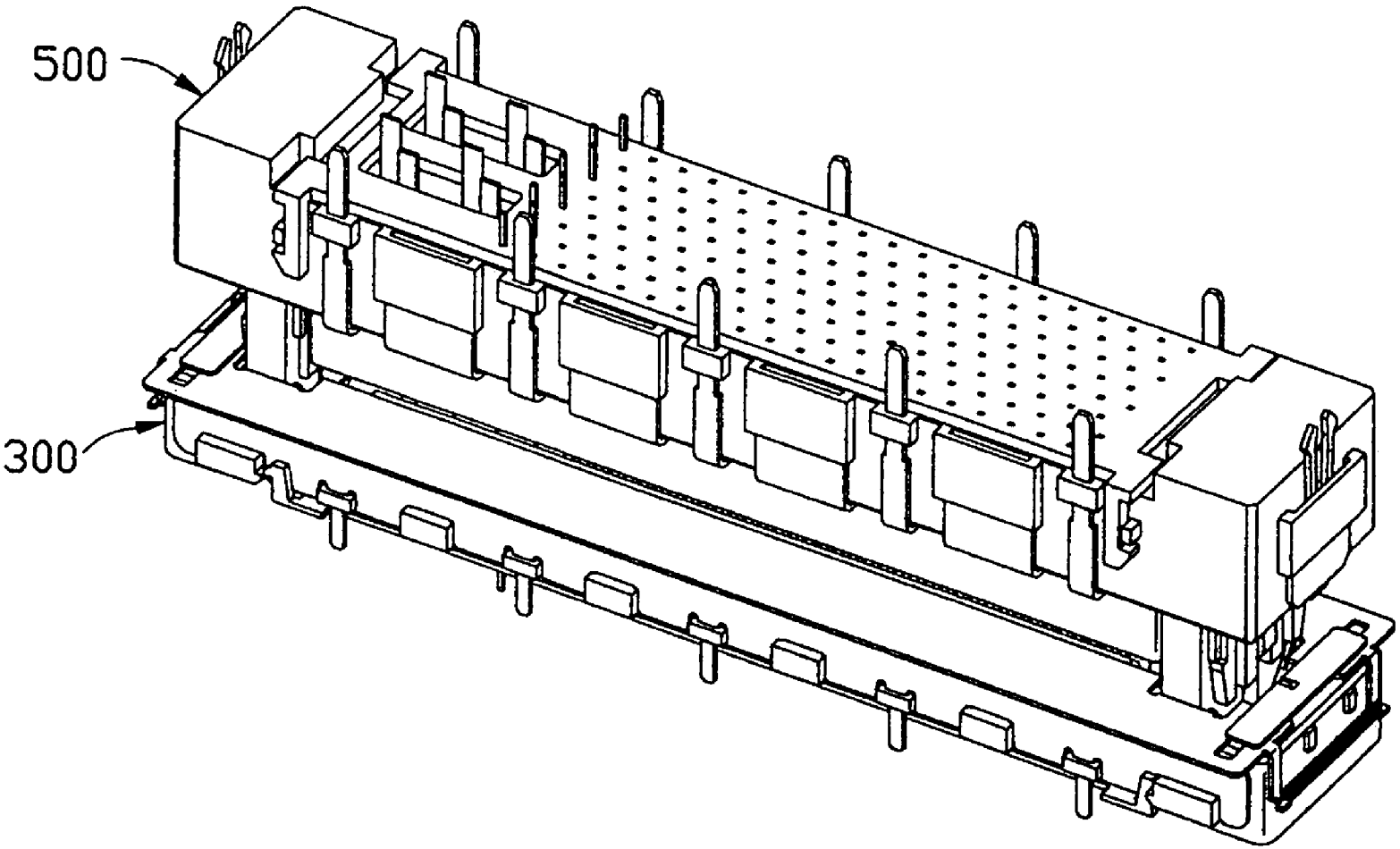
FIG. 6 is an assembled view of the electrical connector partially mating with the mating electrical connector.
Figure 7:
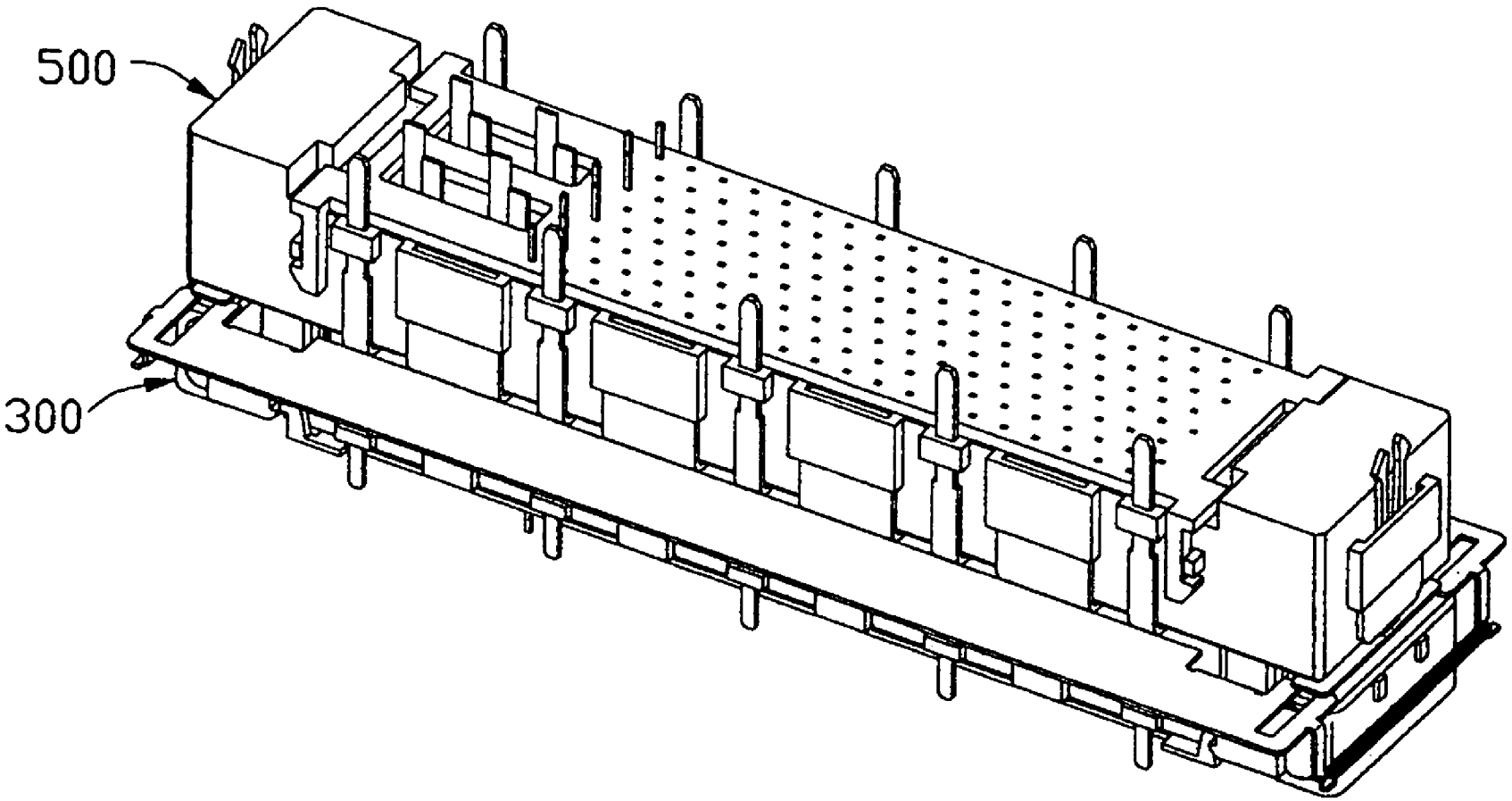
FIG. 7 is a view similar to FIG. 7, but the mating electrical connector mate with the electrical connector completely.

The electrical connector 500 and the mating electrical connector 300 mate to form an electrical connector assembly, as shown in FIG 7. The process of mating the electrical connectors 300, 500 will now be described in greater detail with reference to FIGS. 6–7. As shown in FIG 6, the electrical connector 500 reversed is positioned substantially adjacent to the mating electrical connector 300 such that guiding faces 712 of the top portions 711 of the guiding devices 7 comes into contact with the oblique plates 213, 223 of the shutter members 21, 22. In this state, the insulative housing 1 and the insulative housing 6 are not yet in contact, as the mating electrical connector 300 and the electrical connector 500 contact to each other, the top portions 711 of the guiding devices 7 push the oblique plates 213, 223 apart, due to the push force, the shutter members 21, 22 make transverse translation in the plane of the shutter members 21, 22 by the second engaging portions 212, 222 guiding along the first guiding section, and the shutter members 21, 22 just move in the plane due to the limitation section until the mating portion 11 of the mating electrical connector 300 exposed at an open position. At the same time, the coil springs 3 become longer with larger elasticity. After then, the guiding devices 7 are received in the guiding chamber 151, and the electrical connector 300, 500 mate with each other with the terminals electrically connecting. If the electrical connector 500 is draw from the mating electrical connector 300, the resilience of the coil springs 3, 72 actuate the shutter members 21, 22 and the guiding members 71 to the initial closed status due to the outside force eliminating, the second engaging portions 212, 222 guide the shutter 2 to slide along the first guiding section until the arms 211, 221 are stopped by the stopper members 132 at a closed position, and the guiding members 71 move upwards with the latching protrusions 714 along the grooves 630 until the latching protrusions 714 are stopped by the latching tabs 628 in the original position.

Most of the guiding members 71 can received in the concave chamber after the electrical connector 300, 500 mate with each other, so the electrical connector assembly has a lower profile, and the guiding devices 7 is easy to assembly onto the insulative housing 6, and has a simple structure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed, such as, the coil springs 72 can be other shaped spring members, welding can replace the circular holes 625 and the posts 715 for retaining the spring members to realize the elasticity.

What is claimed is:

1. An electrical connector comprising:

an insulative housing comprising a concave chamber;

a plurality of terminals received in the insulative housing; and a guiding device movably assembled to the insulative housing, the guiding device comprising guiding members and spring members, the spring members arranged in the concave chamber and below the guiding members, the guiding members moving along the concave chamber due to the elasticity of the spring members; wherein the guiding member is substantial hill-shaped and comprises a body potion and a top portion; wherein the top portion comprises a pair of guiding faces and a through hole through two side surfaces thereof.

2. An electrical connector comprising:

an insulative housing comprising a concave chamber;

a plurality of terminals received in the insulative housing; and a guiding device movably assembled to the insulative housing, the guiding device comprising guiding members and spring members, the spring members arranged in the concave chamber and below the guiding members, the guiding members moving along the concave chamber due to the elasticity of the spring members; wherein the insulative housing comprises a base and a mating portion above the base; wherein the mating portion has middle portion and upright walls, and wherein the concave chamber is defined between the middle portion and one of the upright walls in the base; wherein the upright walls are substantial E-shaped opened upwards, each upright wall has two lateral sections and a middle section therebetween.

3. The electrical connector as claimed in claim 2, wherein the lateral section comprises a latching tab acting as a limitation member for limiting the guiding device to get out of the concave chamber.

4. The electrical connector as claimed in claim 2, wherein the concave chamber comprises a cavity with grooves, and the guiding members have latching protrusions on two side faces to slide along the grooves.

5. The electrical connector as claimed in claim 2, wherein the guiding member is substantial hill-shaped and comprises a body potion and a top portion.

6. The electrical connector as claimed in claim 5, wherein the top portion comprises a pair of guiding faces and a through hole through two side surfaces thereof.

7. The electrical connector as claimed in claim 6, further comprising grounding terminals passing through the through holes of the guiding devices.

8. An electrical connector assembly, comprising:

an electrical connector comprising a first insulative housing comprising a concave chamber;

a plurality of terminals received in the first insulative housing; and a guiding device movably assembled to the insulative housing, the guiding device comprises guiding members and spring members, the spring members arranged in the concave chamber and below the guiding members, the guiding members moving along the concave chamber due to the elasticity of the spring members, and wherein the first insulative housing comprises a base and a first mating portion above the base a mating electrical connector comprising a second insulative housing comprising a second mating portion;

a plurality of terminals received in the second insulative housing; and a shutter movably assembled to the second insulative housing to close and open the second mating portion of the insulative housing; wherein the first mating portion has a middle portion and upright walls, and the concave chamber is defined between the middle portion and one of the upright walls in the base; wherein the upright walls are substantial E-shaped opened upwards, each upright wall has two lateral sections and a middle section therebetween.

9. The electrical connector assembly as claimed in claim 8, wherein the mating electrical connector comprises a sliding and limiting mechanism for guiding the shutter to slide in a plane perpendicular to an electrical connector insertion direction between a closed portion and an open position.

10. The electrical connector assembly as claimed in claim 9, wherein the sliding and limiting mechanism comprises a first engaging portion formed on the second insulative housing and a second engaging portion formed on the shutter for mating with the first engaging portion.

11. The electrical connector assembly as claimed in claim 10, wherein the first engaging portion of the second insulative housing is a protrusion with a T-shaped cross-section protruding from an upper surface of the second insulative housing, correspondingly, the second engaging portion is an elongated slot.

12. The electrical connector assembly as claimed in claim 8, wherein the upright wall comprises a latching tab acting as a limitation member for limiting the guiding device to get out of the concave chamber.

* * * * *